US010470588B2

(12) United States Patent
Bryan et al.

(10) Patent No.: US 10,470,588 B2
(45) Date of Patent: Nov. 12, 2019

(54) MODULAR LABEL TRACK SYSTEM

(71) Applicant: Walmart Apollo, LLC, Bentonville, AR (US)

(72) Inventors: Greg Bryan, Bentonville, AR (US); Robert James Taylor, Rogers, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/848,769

(22) Filed: Dec. 20, 2017

(65) Prior Publication Data

US 2018/0168366 A1 Jun. 21, 2018

Related U.S. Application Data

(60) Provisional application No. 62/437,409, filed on Dec. 21, 2016.

(51) Int. Cl.

| | |
|---|---|
| ***A47F 5/00*** | (2006.01) |
| ***A47F 5/08*** | (2006.01) |
| ***G09F 3/20*** | (2006.01) |

(52) U.S. Cl.

CPC ..... *A47F 5/0068* (2013.01); *A47F 5/0869* (2013.01); *G09F 3/204* (2013.01); *G09F 3/208* (2013.01); *G09F 3/201* (2013.01)

(58) Field of Classification Search

CPC ..... A47F 5/0068; A47F 5/0869; G09F 3/204

See application file for complete search history.

(56) References Cited

U.S. PATENT DOCUMENTS

| | | | | |
|---|---|---|---|---|
| 4,593,824 | A * | 6/1986 | Pfeifer | A47F 5/0869 211/57.1 |
| 6,035,569 | A | 3/2000 | Nagel et al. | |
| 6,481,133 | B1 * | 11/2002 | DeSena | G09F 3/204 40/649 |
| 6,796,445 | B2 | 9/2004 | Cyrluk | |

(Continued)

FOREIGN PATENT DOCUMENTS

| | | |
|---|---|---|
| CA | 2798624 C | 1/2014 |
| EP | 0557361 B1 | 10/1996 |

OTHER PUBLICATIONS

"Pop Rotating Sign Clip Merchandise Clamp Clear With Price Label Holder 10 PCS," Ebay.com, accessed Oct. 5, 2016.

*Primary Examiner* — Gary C Hoge

(74) *Attorney, Agent, or Firm* — Schmeiser, Olsen & Watts LLP; Lawrence P. Zale

(57) ABSTRACT

A shelf label system for organization of products according to a modular plan identifies product information on a retail store shelf. It retains original location and product information. The system comprises at least one elongated shelf label track attached to a front face of the retail store shelf, a plurality of label holders, each fitting within and able to move along a length of the shelf label track. Each label holder has a hinged panel that can be folded such that only a first face of the hinged panel is visible. In an open position, a face of the main panel and a second face of the hinged panel are visible. In an alternative embodiment, the label holders are allowed to move along the slot but can only flip over in the cutouts. A locking cover may be implemented to prevent unauthorized persons from modifying the labels.

19 Claims, 4 Drawing Sheets

(56) References Cited

U.S. PATENT DOCUMENTS

| | | | | |
|---|---|---|---|---|
| 7,340,856 | B1 | 3/2008 | Kalouris | |
| 7,530,188 | B2 | 5/2009 | Beilenhoff et al. | |
| 2002/0034067 | A1* | 3/2002 | Massaro | A47F 5/0068 361/728 |
| 2003/0136832 | A1* | 7/2003 | Massaro | A47F 5/0068 235/383 |
| 2005/0046692 | A1* | 3/2005 | Bronson | B41J 2/435 347/224 |
| 2011/0239501 | A1* | 10/2011 | Ricci | G09F 3/204 40/541 |
| 2012/0073174 | A1 | 3/2012 | Bird et al. | |
| 2016/0133165 | A1* | 5/2016 | Joliey | G09F 3/204 40/5 |

* cited by examiner

MODULAR LABEL TRACK SYSTEM

RELATED APPLICATIONS

This application claims the benefit of U.S. Provisional Patent Application No. 62/437,409, filed Dec. 21, 2016, entitled "Modular Label Track System," the contents of which are incorporated by reference herein in their entirety.

FIELD

Aspects of the present invention relate to a system for identifying products on a retail shelf, and more specifically to a system for identifying products on a retail shelf according to a modular organization that retains a modular sequence and position of products as they are added and removed.

BACKGROUND

One method of displaying goods for sale would be to position them on elongated store shelves organized into a number of modular spaces or "modules". Locations of products on shelves may now be found by their aisle and module designations. Typically, a product offered for sale is placed in one or more adjacent modules according to an overall modular plan. The modular plan indicates the aisle and module where each product is displayed.

The modular plan allows store associates to more easily find a desired product location. An associate would need to find a product location when re-stocking that location when there are few or no products at that location.

If a product is out of stock, leaving an empty module (a 'gap') can be 'plugged' with another product. Plugging a module is stocking the module with a temporary replacement product which is intended to be removed when a shipment of the original product has been received.

Alternatively, the 'gap' can be 'collapsed'. 'Collapsing' a module is temporarily allocating a portion or all of the space of the module to at least one adjacent module.

These are two examples of changing ("flexing") the modular spaces.

Current systems for keeping track of inventory for modular layouts are not effective mechanisms since they do not indicate whether a product is in its correct module (location) due to plugging and collapsing of modules.

When a product's modular space is adjusted or 'flexed', either due to a temporary or permanent store plan, it typically remains that way until it is discovered by a store employee such as an associate or manager. Discovery usually requires the store associate to find and compare the current layout to the modular plan to correct the layout. This can be accomplished by acquiring information which may include a listing of facings, shelf capacity, and the modular sequence number. This may require that the store associates have a device such as a handheld printer to print out the modular information and/or plans to correct the layout.

Since the associates cannot tell which modules are improperly stocked using current systems, they must check the layout regularly. Searching for and finding flexed modules on a regular basis requires time on the part of the associates and prevents them from doing more productive tasks.

With current organization systems, it is also difficult to determine which modules are currently filled with temporary products, and which temporary product should be replaced with the original product once the shipment of the original product is received.

Maintaining the original modular plan is important. Flexibility to change the location of some products in certain circumstances is also required.

Currently, there is a need for a system of labeling which allows for flexible modular organization of products, but also indicates how to reorganize the products back into their original modular plan.

BRIEF SUMMARY

According to aspects of the present inventive concepts there is provided an apparatus and method as set forth in the appended claims. Other features of the inventive concepts will be apparent from the dependent claims, and the description which follows.

One embodiment of the current invention may be described as a shelf label system for modular product organization that identifies product information on a retail store shelf having at least one elongated shelf label track attached to a front face of the retail store shelf, a plurality of label holders, each fitting within and able to move along a length of the shelf label track, each shelf label holder associated with a modular space on the retail store shelf. Each label holder has a main panel, and a hinged panel which is connected to the main panel with a hinge, and which can be folded in a closed position covering the main panel such that only a first face of the hinged panel is visible. The label holder may also be in an open position opened away from the main panel, such that a face of the main panel and a second face of the hinged panel are visible and show information on a temporary product.

The current invention may also be embodied as a method of displaying labels for products on retail shelves arranged in a modular fashion, having the steps of providing an elongated shelf label track which is mounted on a front face of a retail shelf, extending past a plurality of modular spaces, and a plurality of label holders that may slide along the shelf label track. The label holders may be in a closed position exposing a first face of a hinged panel or be in an open position, exposing a second face of the hinged panel and the face of the main panel, stocking products each at a designated modular space, positioning label holders adjacent to a plurality of modular spaces, and attaching a label to a first face of the hinged panels having product labeling information relating to the adjacent product. When there is no longer any of the product in a modular space, then stocking an empty modular space with a temporary product for a temporary period of time, opening the label holders at the modular space of the temporary product to an open position to hide the first face of the hinged panel, expose a second face of the hinged panel and the face of the main panel, attaching an indication to one of the exposed second face of the hinged panel and the face of the main panel that the product located at the modular space is temporarily unavailable.

The current invention may also be embodied as a shelf label system for modular product organization that identifies information of products having a retail shelf that is divided into a plurality of modular spaces, at least one elongated shelf label conduit attached to a front face of at least one retail shelf, the shelf label conduit having a lengthwise slot and enlarged cutouts, and a plurality of label holders. Each label holder includes a head within the shelf label conduit and is able to move along a length of the shelf label track, each label holder associated with and positioned adjacent to a modular space on the retail shelf, a flattened neck coupled to the head having a thickness allowing it to extend and slide through a slot, and a panel coupled to the neck. The panel has a first face adapted to display information of a product located in an adjacent modular space and a second face adapted to display information indicating that the product is unavailable when there are no products in the modular space. The head, neck and cutouts are sized and shaped to allow the panel to flip to change within a cutout between a 'normal position' of the first face being outward and visible and a 'product unavailable position' in which the second face is outward and visible.

BRIEF DESCRIPTION OF SEVERAL VIEWS OF THE DRAWINGS

The above and further advantages may be better understood by referring to the following description in conjunction with the accompanying drawings, in which like numerals indicate like structural elements and features in various figures. The drawings are not necessarily to scale; emphasis instead being placed upon illustrating the principles of the concepts. For example, the dimensions of some of the elements in the figures may be exaggerated relative to other elements to help to improve understanding of various example embodiments. Also, common but well-understood elements that are useful or necessary in a commercially feasible embodiment are often not depicted in order to facilitate a less obstructed view of these various example embodiments.

DETAILED DESCRIPTION

Theory

The current shelf label system would be used when initially setting up products according to a desired modular plan. It may also be used when the modular plan changes, when prices change, and when items are being counted. The shelf label system displays the product and price information which customers use to make purchasing decisions.

In the case of plugging a module, collapsing a module, etc. the labeling should indicate information about the temporary product. There should also be some visible indication to the store associate that the module is being filled with a temporary product, and an indication of the original product stored in this module.

In the case of collapsing a module, there should be an indication, at least to the store associate, of the location of an original module for an original product, when the product is out of stock and the module has been collapsed.

These must exist along with the ability to revert back to an original modular plan.

Implementation

The structure and functioning of the current invention will be described in connection with FIG. 1 which is a block diagram showing the main elements of a modular track label system in accordance with one embodiment of the present invention.

Figure 1:
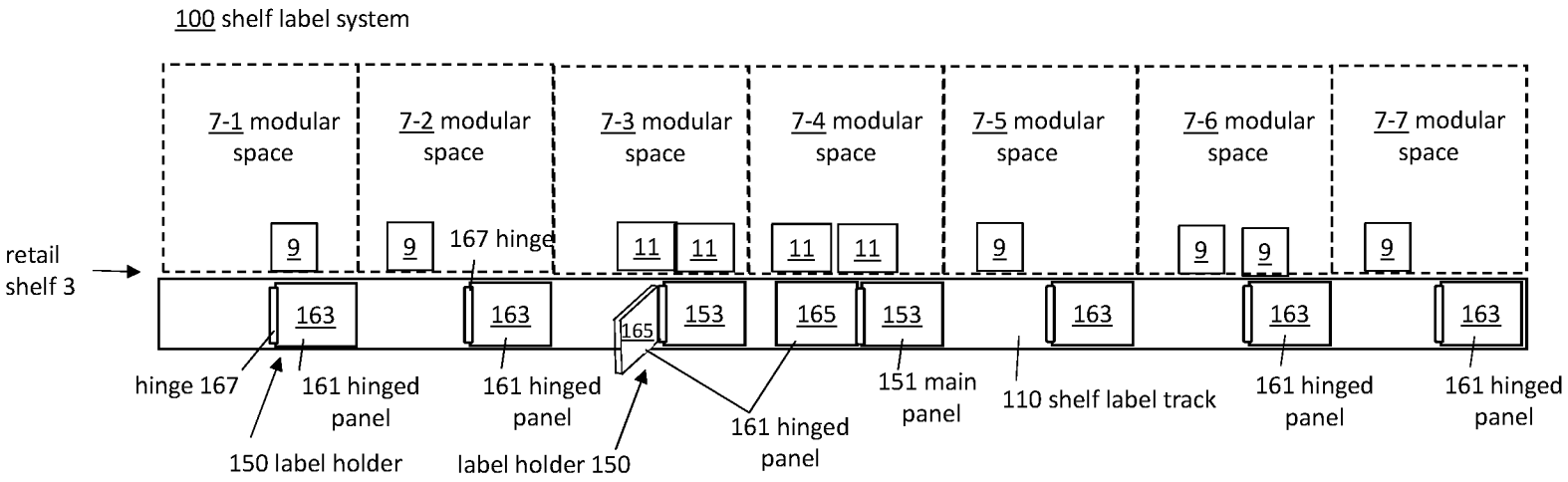
FIG. 1 is a block diagram showing the main elements of a modular track label system in accordance with one embodiment of the present invention.

A typical retail shelf 3 in a store is shown in FIG. 1. The retail shelf 3 is divided into modular spaces 7-1, 7-2 . . . 7-7 (collectively referred to as modular space 7). These modular spaces 7 in FIG. 1 are shown having the same width. However, these modular spaces may be adjusted (flexed) such that a module may be collapsed and the space is allocated to one or more adjacent modular spaces.

Original products 9 are stored on retail shelf 3 at each of the modular spaces shown here except for modular space 7-3 and 7-4. A temporary product 11 is shown being stored at modular spaces 7-3 and 7-4. The temporary product 11 may be placed there because the original product 9 which is intended to be there may be out of stock, or discontinued. Replacing a product with another product in the same modular space is referred to as "plugging" the modular space.

Depending upon the size and quantity of the product, several modular spaces may be allocated to that product.

A shelf label track 110 is attached to the front face of the retail shelf 3. This typically has upper and lower edges which are designed to hold a plurality of label holders 250, but allows it to slide along the length of shelf label track 110.

A plurality of hinged panels 161 has a first face 163 which is visible when the hinged panel 161 is in the closed position, as is shown for modular spaces 7-1, 7-2, 7-5, 7-6 and, 7-7.

The first face 163 of hinged panel 161 is used to hold a label that has product information and typically pricing for the original products 9 at each of the modular spaces.

However, since modular spaces 7-3 and 7-4 have a temporary product 11, the product information on the first face 163 of hinged label 161 does not apply to these temporary products. The hinged panel 161 adjacent to modular space 7-3 is shown in a partially opened position which now exposes a face 153 of a main panel 151, and a second face 165 of hinged panel 161.

The hinged panel 161 is in its fully opened position as shown adjacent to modular space 7-4. Here it can be seen that hinged panel 161 is now flat against shelf label track 110 showing second face 165 and showing the face 153 of main panel 151.

Since there are now two faces that are visible, one face may be used to display information of temporary product 11 and the second face may be used to indicate that the original product 9 is currently out of stock and that temporary product 11 is being stored in the modular space in place of the original product 9.

Figure 2:
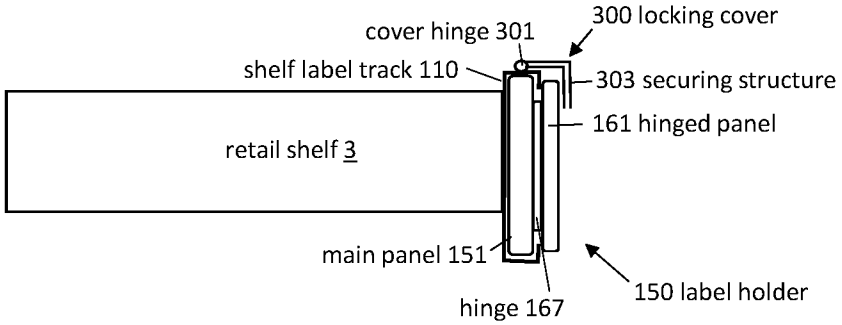
FIG. 2 is a side elevational cross-sectional view of the modular track label system of FIG. 1.

FIG. 2 is a side elevational cross-sectional view of the modular track label system of FIG. 1. FIG. 2 shows a portion of the retail shelf 3 with the shelf label track 110 attached to its front face. A label holder 150 is shown in cross-section partially inside shelf label track 110.

Shelf label track 110 has top and bottom projections angled towards its center that retain main panel 151. A hinge 167 is attached between main panel 151 and hinged panel 161. As shown in FIG. 2, hinged panel 161 is folded over the top of main panel 151.

In an optional embodiment there is a locking cover 300 having a securing structure 303 which extends at least partially over the main panel 151 and hinged panel 161. This prevents any changes to the position of hinged panel 161 relative to main panel 151.

Locking cover 300 is shown in cross-section here but it may extend for a portion of shelf label track 110, or for substantially the entire length of shelf label track 110.

Securing structure 303 may be pivoted upward on cover hinge 301 so as to allow hinged panel 161 to be flipped open relative to main panel 151, or to move label holder 150 along shelf label track 110.

Securing structure 303 may then be positioned as shown in FIG. 2 to lock main panel 151 and hinged panel 161 in place. Optionally, locking cover 300 may include a lock and key to prevent shoppers from tampering with label holder 150.

Figure 3:
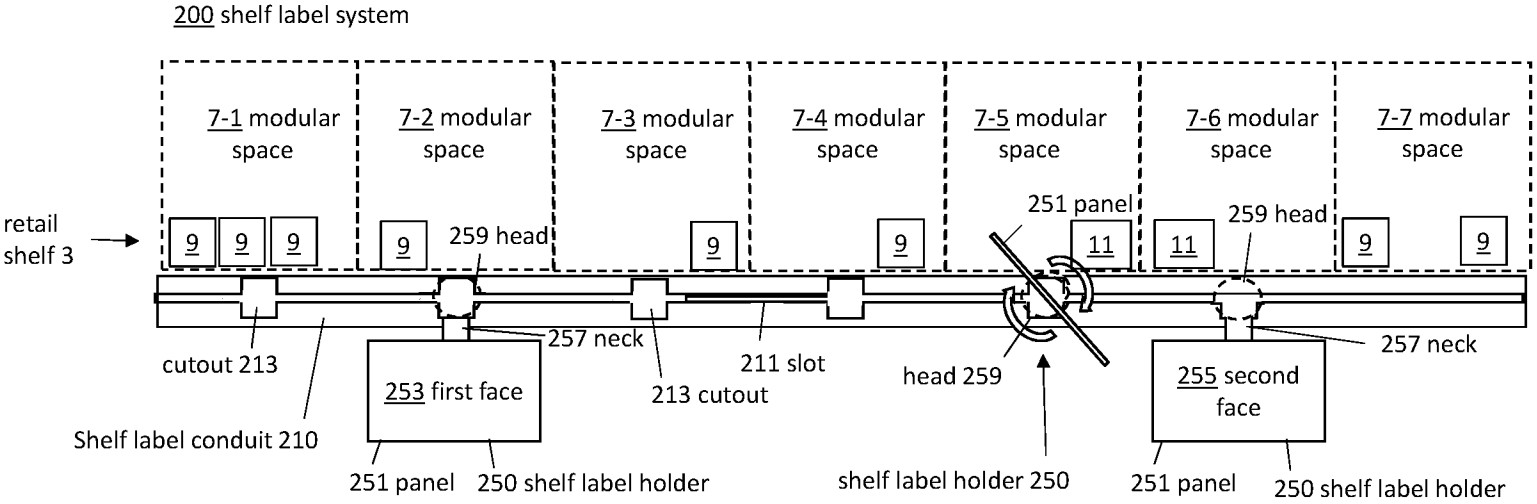
FIG. 3 is a block diagram showing the main elements of a modular track label system in accordance with another embodiment of the present invention.

FIG. 3 is a block diagram showing the main elements of a modular shelf label system 200 in accordance with another embodiment of the present invention. A retail shelf 3 is shown having a plurality of modular spaces 7-1, 7-2, 7-3, . . . 7-7. Modular spaces 7-1, 7-2, 7-3, 7-4 and 7-7 are stocked with the original product 9. Modular spaces 7-5 and 7-6 are stocked with a temporary product 11 since original product 9 is unavailable.

In this embodiment, a shelf label conduit 210 extends for substantially the entire length of retail shelf 3. A slot 211 extends on a front side of shelf label conduit 210 for most of its length. There is a plurality of enlarged openings, referred to as cutouts 213 positioned along the length of shelf label conduit 210.

A plurality of shelf label holders 250 have an enlarged head 259 which is contained within shelf label conduit 210, and allowed to slide inside shelf label conduit 210. Each head 259 is connected to a neck 257 having a cross-section small enough to fit into and slide along slot 211. A panel 251 is connected to each neck 257. Each panel 251 has a 1st face 253 and a second face 255.

In FIG. 3, shelf label holder 250 at modular space 7-2 is positioned to show first face 253 that carries a label or is printed with information relating to original product 9.

Shelf label holder 250 is allowed to be moved upward and pivoted on head 259 such that the neck 257 fits into and slides along slot 211. Shelf label holder 250 may then be moved left or right to different cutouts 213. Once the shelf label holder 250 is positioned in a cutout 213, such as shelf label holder 250 adjacent to modular space 7-5, it may be allowed to be rotated as shown by the arrows. This allows shelf label holder 250 to pivot and then be moved downward into the position shown for shelf label holder 250 adjacent to modular space 7-6. This now shows the second face 255 and information relating to a temporary product 11 adjacent to the shelf label holder 250 in the modular space 7-6.

This shelf label system 200 therefore allows shelf label holders 250 to be moved from one cutout 213 to another, while keeping their relative sequence, and preserving the modular organization.

Figure 4:
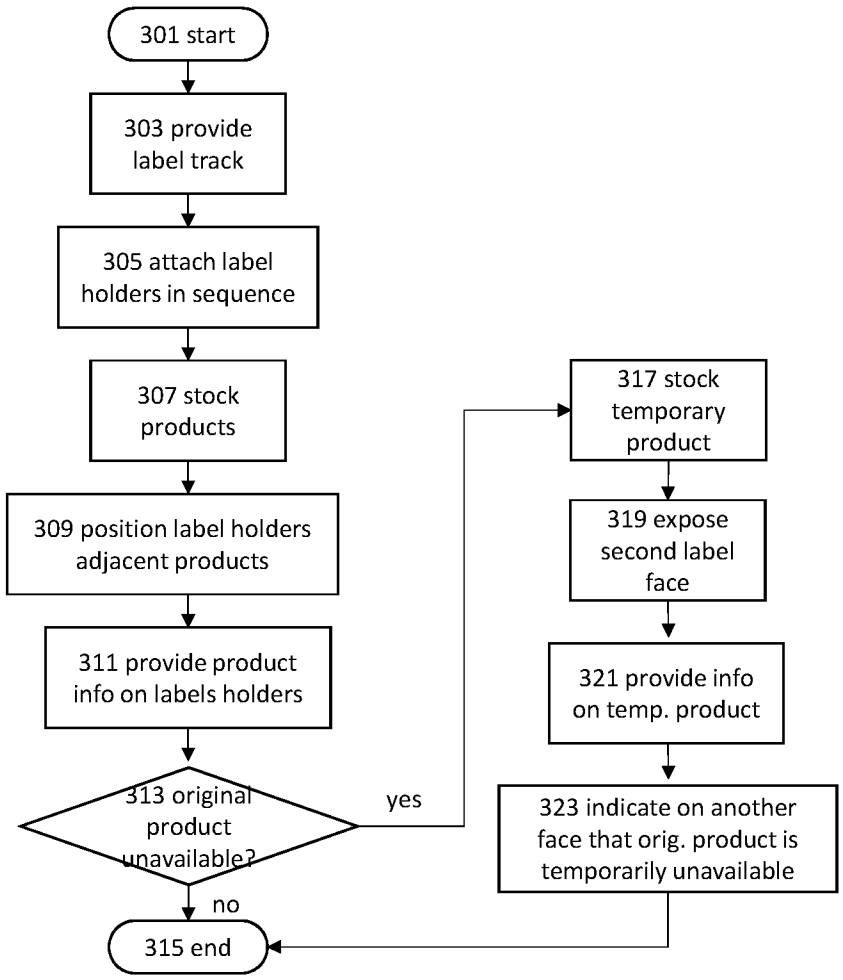
FIG. 4 is a flowchart indicating a process according to one embodiment of the current invention.

FIG. 4 is a flowchart indicating a process according to one embodiment of the current invention. The method of displaying labels for products 9 on retail shelves 3 arranged in a modular fashion starts at step 301.

In step 303, an elongated shelf label track 110 is provided that is mounted on a front face of a retail shelf 3. The elongated shelf label track 110 extends adjacent to the plurality of modular spaces 7.

In step 305, a plurality of label holders 150 are slidingly attached to the shelf label track 110 sequenced according to a modular plan. The label holders 150 have a main panel 151 hinged to a hinged panel 161. Each shelf label holder may be in a closed position exposing a first face 163 of a hinged panel 161 or be in an open position, exposing a second face 165 of the hinged panel 161 and the face 153 of the main panel 151.

In step 307, each original product is stocked at a designated modular space 7, according to a modular organization plan.

In step 309, a label holder 150 is positioned adjacent to a modular space 7.

In step 311, product information pertaining to each original product in the modular space adjacent the label holder is provided on the label holder's first face 163 of the hinged panels 161. This information may be printed on a label which is attached to the label holder.

In step 313, it is determined if the original product 9 is unavailable; if so, ("yes") then the process continues at step 317. If not ("no"), the process ends at step 315.

In step 317, a temporary product 11 is stocked in the empty modular space 7 previously filled by the original product, for a temporary period of time.

In step 319, the label holder 150 is opened to an open position to hide the first face 163 of the hinged panel 161, and to expose the second face 165 of the hinged panel 161 and the face 153 of the main panel 151.

In step 321, product information of the temporary product 11 is provided on one of the exposed faces 153, 165.

In step 323, an indication is attached to one of the exposed faces 153, 165 that the original product 9 that was located at the modular spaces 7-3, 7-4 is now temporarily unavailable.

Therefore, as indicated above, the modular spaces may be flexed to plug or collapse a modular space, but retain all of the information required to return the current layout back to its original modular plan.

Alternative Embodiments

In an alternative embodiment of the current invention, the shelf label track 110 may have 'slide rule' style demarcations along its length to identify the beginning or end of an original module space and expanded modular spaces. It can also identify the original location of collapsed modular spaces, the original locations of labels, etc.

Another alternative embodiment of the current invention incorporates a lock which requires a key to unlock the locking cover 300.

Functionality

Therefore, it can be seen that the current system has the ability to easily display labels and return them to their original state with little work, effort or research.

The current system allows for increased visibility of store modular changes for reporting purposes.

The increased visibility of store modular changes more easily allows for recommendations on modular design improvements.

The current system restricts modular design changes and alterations in the store to authorized users.

Although a few examples have been shown and described, it will be appreciated by those skilled in the art that various changes and modifications might be made without departing from the scope of the invention, as defined in the appended claims.

What is claimed is:

1. A shelf label system for modular product organization that identifies product information on a retail store shelf comprising:

a. at least one elongated shelf label track attached to a front face of the retail store shelf;

b. a plurality of label holders, each fitting within the shelf label track in a fixed sequential order and able to move along a length of the shelf label track but not change their sequential order, each shelf label holder is associated with a modular space on the retail store shelf and comprises:

i. a main panel which is slidingly connected to the shelf label track;

ii. a hinged panel which is pivotally connected to the main panel, which can be folded in a closed position covering the main panel such that only a first face of the hinged panel is visible; and an open position opened away from the main panel, such that a face of the main panel and a second face of the hinged panel are visible.

2. The shelf label system of claim 1 wherein the hinged panel is associated with a product and is adapted to be folded into a closed position and the first face of hinged panel has information about the product, when a product is in stock and available.

3. The shelf label system of claim 1 wherein the hinged panel is unfolded into its open position and the second face of hinged panel is visible and indicates that the product is unavailable, when a product is not available.

4. The shelf label system of claim 3 wherein the main panel is visible and has information on a temporary product that is in a location previously filled by the unavailable product.

5. The shelf label system of claim 1 wherein each of the plurality of label holders can be moved to be adjacent to a modular space with which it is associated.

6. The shelf label system of claim 1, wherein the retail store shelf is divided into a plurality of modular spaces.

7. The shelf label system of claim 1, wherein at least one of the face of the main panel and the second face of the hinged panel of the label holders display information of a replacement product.

8. The shelf label system of claim 1 further comprising a locking cover fitting over the shelf label track and label holders preventing the label holders from moving along the shelf label track or flipping between the 'normal position' and the 'product unavailable position'.

9. A method of displaying labels for products on retail shelves arranged in a modular fashion, comprising the steps of:

a) providing an elongated shelf label track which is mounted on a front face of a retail shelf, extending past a plurality of modular spaces;

b) slidingly attaching to the shelf label track a plurality of label holders that may be in a closed position exposing a first face of a hinged panel or be in an open position, exposing a second face of the hinged panel and the face of the main panel;

c) stocking products each at a designated modular space;

d) positioning label holders adjacent to a plurality of modular spaces;

e) attaching a label to a first face of the hinged panels having product labeling information relating to the adjacent product;

f) when there is no longer any of the product in a modular space, then:

i. stocking an empty modular space with a temporary product for a temporary period of time;

ii. opening the label holders at the modular space of the temporary product to an open position to hide the first face of the hinged panel, expose a second face of the hinged panel and the face of the main panel;

iii. attaching an indication to one of the exposed second face of the hinged panel and the face of the main panel that the product located at the modular space is temporarily unavailable.

10. The method of claim 9 further comprising the step of:

attaching a label to one of the exposed second face of the hinged panel and the face of the main panel, having labeling information about the temporary product.

11. The method of claim 9, wherein the step of slidingly attaching to the shelf label track a plurality of label holders comprises the steps of:

slidingly attaching to the shelf label track, a plurality of label holders in a specific sequence that cannot change their relative sequential order.

12. The method of claim 9, wherein the step of providing an elongated shelf label track comprises the step of:

identifying the beginning and end of each modular space.

13. The method of claim 9, wherein the step of providing an elongated shelf label track comprises the step of:

displaying, on at least one of the face of the main panel and the second face of the hinged panel of the label holder, information of a replacement product.

14. A shelf label system for modular product organization that identifies information of products comprising:

a. a retail shelf that is divided into a plurality of modular spaces;

b. at least one elongated shelf label conduit attached to a front face of at least one retail shelf, the shelf label conduit having a lengthwise slot and enlarged cutouts;

c. a plurality of label holders each comprising:

i. a head within the shelf label conduit and able to move along a length of the shelf label track, each label holder associated with and positioned adjacent to a modular space on the retail shelf;

ii. a flattened neck coupled to the head having a thickness allowing it to extend and slide through slot;

iii. a panel coupled to the neck having a first face adapted to display information of a product located in an adjacent modular space, and a second face adapted to display information indicating that the product is unavailable when there are no products in modular space;

d. wherein the head, neck and cutouts are sized and shaped to allow the panel to flip to change between a 'normal position' of the first face being outward and visible and a 'product unavailable position' in which the second face is outward and visible when the label holder is positioned within a cutout.

15. The shelf label system of claim 14 wherein the label holder associated with a product in a modular space is in a 'normal position' with the first face being visible and having information about the product, when the product is in stock and available.

16. The shelf label system of claim 14 wherein the label holder associated with a product in a modular space is in a 'product unavailable position' with the second face being visible and having information indicating that the product is unavailable, when a product is not available.

17. The shelf label system of claim 16 wherein the second face is visible and has information on a temporary product that is in the modular space previously occupied by the currently unavailable product.

18. The shelf label system of claim 14 wherein the plurality of label holders are inserted into the shelf label conduit in a specific order matching the order of the modular spaces, and the label holders cannot change their sequential order.

19. The shelf label system of claim 14 wherein each of the plurality of label holders can be moved to be adjacent to an associated modular space if the modular space changes position on the store shelf.

* * * * *